United States Patent [19]

Andersson et al.

[11] Patent Number: 4,475,655

[45] Date of Patent: Oct. 9, 1984

[54] PACKING CONTAINER

[75] Inventors: Pär Andersson; Rolf Viberg, both of Bjärred, Sweden

[73] Assignee: Tetra Pak International AB, Lund, Sweden

[21] Appl. No.: 399,831

[22] Filed: Jul. 19, 1982

[30] Foreign Application Priority Data

Aug. 13, 1981 [SE] Sweden ..... 8104813

[51] Int. Cl.[3] ..... B65D 17/40

[52] U.S. Cl. ..... 206/624; 206/621; 206/627; 206/628; 229/44 R

[58] Field of Search ..... 206/620, 621, 623, 624, 206/625, 627, 628, 629, 630, 634, 622; 229/3.5 R, 44 R, 44 CB, 44 EC, 45 R; 220/DIG. 25

[56] References Cited

U.S. PATENT DOCUMENTS

| | | | |
|---|---|---|---|
| 209,417 | 10/1878 | O'Bryon | 229/44 R |
| 869,793 | 10/1907 | Meinecke | 229/44 R |
| 1,920,227 | 8/1933 | Wilder | 206/624 |
| 2,082,677 | 6/1937 | Belsinger | 229/44 R |
| 2,401,417 | 6/1946 | Engle | 206/620 |
| 2,784,896 | 3/1957 | Hoag . | |
| 2,858,057 | 10/1958 | Mullinix . | |
| 3,404,988 | 10/1968 | Rausing | 206/630 |
| 3,434,849 | 3/1969 | Carbone | 206/624 |
| 3,958,747 | 5/1976 | Chipp et al. | 206/624 |
| 4,253,572 | 3/1981 | Halbich | 220/306 |

FOREIGN PATENT DOCUMENTS

| | | |
|---|---|---|
| 132212 | 11/1975 | Denmark . |
| 138484 | 9/1978 | Denmark . |
| 1178006 | 9/1964 | Fed. Rep. of Germany . |
| 2854709 | 7/1980 | Fed. Rep. of Germany . |
| 1207899 | 2/1960 | France . |
| 2267248 | 11/1975 | France . |
| 330505 | 11/1970 | Sweden . |
| 568891 | 11/1975 | Switzerland . |

*Primary Examiner*—George E. Lowrance
*Assistant Examiner*—Jimmy G. Foster
*Attorney, Agent, or Firm*—Burns, Doane, Swecker & Mathis

[57] ABSTRACT

Small packing containers such as individual packages for yogurt, ice-cream or the like, are frequently in the form of beakers provided with a lid consisting of a tear-off foil. To reduce the risk of leakage and provide a packing container of greater mechanical strength a beaker type packing container has been provided with an integrated, openable top side otherwise made of the same material as the beaker. The top remains connected to the packing container after it is opened.

8 Claims, 3 Drawing Figures

PACKING CONTAINER

BACKGROUND AND SUMMARY OF THE PRESENT INVENTION

The present invention relates generally to a packing containers. More specifically, the present invention relates to a packing container including two U-shaped parts which border on, and are sealed to, one another along a common edge.

A packing container of this type is known from Swedish Pat. No. 330,505. The packing container disclosed in the patent specification is intended for liquid goods such as milk, cream etc. and includes an opening arrangement to facilitate the emptying of the contents. The opening arrangement is in the form of an emptying hole punched out of the packing container wall which is covered by a tear-off strip (so-called pull-tab). This type of emptying opening is easily openable and in many cases is suited to its purpose, but it cannot be used for solid or semi-solid products, e.g, yogurt, ice-cream or the like. Since the packing container as such is very suitable for such products it is desirable now to provide the packing container with an opening arrangement which renders even this type of contents accessible for consumption. The opening arrangement should not involve making the packing container as a whole more complicated to manufacture or to use, e.g. by providing it with applied components to facilitate the opening, e.g. tearing strips, tearing wires or the like. The packing container moreover should be easy to open and convenient to handle at the same time as, through its design, the risk of unintentional opening in connection with transport or other handling is kept to a minimum. Lastly the design of the packing container should be such that it can be manufactured without appreciable modifications to existing machines.

It is an object of the present invention therefore to provide a packing container which complies well with the abovementioned requirements and is economically attractive to producers and consumers alike.

It is a further object of the present invention to provide a packing container of the abovementioned type with a simple, easily openable opening arrangement which does not complicate the handling or transport of the packing container.

These and other objects have been achieved in accordance with the invention in that a packing container of the type described earlier includes an openable top side serving as a lid which extends at an angle to, and is in hinged connection with, the back of the packing container.

A preferred embodiment of the packing container in accordance with the invention, moreover, has been given the characteristics evident from the description below.

The packing container in accordance with the invention complies well with the requirements specified above, insofar as they concern openability, accessibility of the contents and handling, owing to the whole top side of the packing container serving as a lid. The lid is in hinged connection with the back of the packing container and thus remains on the package after the opening, which reduces the risk of causing litter in the countryside and makes possible the reclosure of the packing container.

By placing a weakening line at a little distance below the lid, a part of the side walls will accompany the lid when the same is opened. These parts of the side walls are firmly attached to the underside of the lid and serve as stiffening beams which give the lid stability and steady it during the actual opening procedure as well as when the lid is to be reclosed.

The design of the cut lines and their mutually slightly displaced location permits a simple opening of the packing container and provides the opened packing container with a clean and even cut edge. The location of the outside cutting line at a short distance below the lid facilitates the initiation of the opening procedure, since the user is able with the help of a finger (usually the thumb) which grips on the underside of the lid edge to press at the same time against the weakening line so that the material breaks in this region thus facilitating considerably the separation of the material in connection with the opening up of the lid.

BRIEF DESCRIPTION OF THE DRAWINGS

The packing container will now be described in more detail with special reference to the attached drawings which illustrate schematically a preferred embodiment of the packing container in accordance with the invention.

DETAILED DESCRIPTION OF THE PREFERRED EMBODIMENT

Figure 1:
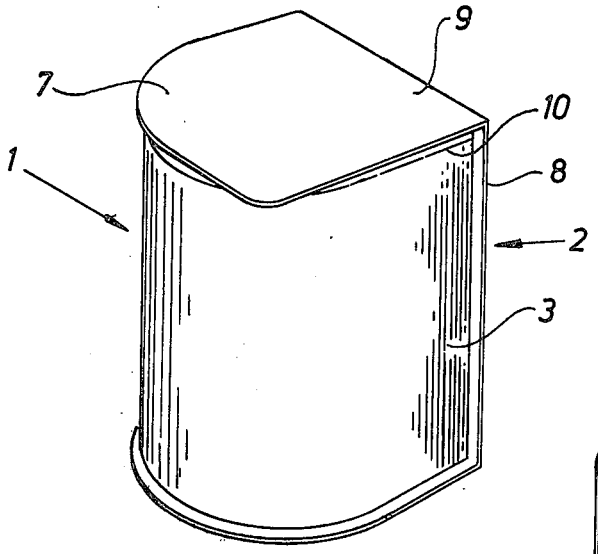
FIG. 1 is a perspective view of a packing container in accordance with the invention.
Figure 2:
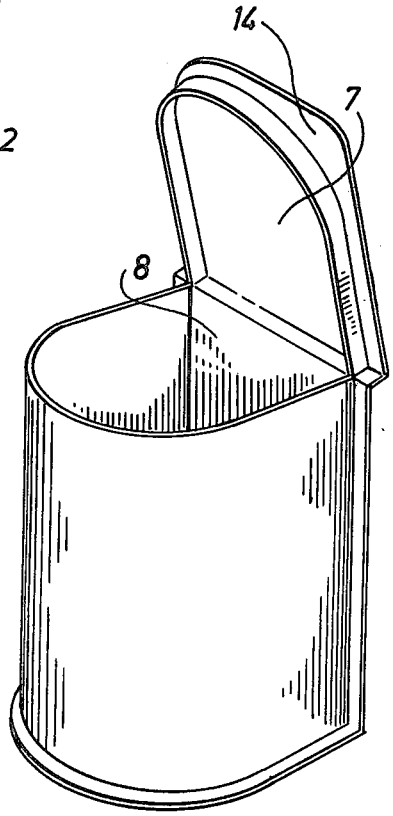
FIG. 2 is a perspective view of the packing container in accordance with FIG. 1 in an opened condition.

The packing container shown in FIG. 1 includes two U-shaped main parts, namely a curved, U-shaped part 1 which forms the front and side surfaces of the package and a rectangular bent U-shaped part 2 which forms the back, bottom and top walls of the package. The U-shaped main parts 1, 2 of the packing container are shaped and placed so in relation to each other, that the open parts of the one are covered by the wall surfaces of the other and vice versa. The main parts of the package are welded in a liquid-tight manner to one another along a common edge 3 which extends in a closed loop along the bordering surface common to both main parts of the package. The packing container is manufactured from a liquid-tight, laminated material including at least a carrier layer 4 (FIG. 3) of foamed plastic material, e.g. polystyrene, covered on both sides with thin, homogeneous layers 5, 6 of a likewise thermoplastic material which may also be polystyrene or some other, suitable plastic. Owing to the laminate having at least on the outside a layer of thermoplastic material the two main parts of the packing container can be heat-sealed to each other by heating along the edges which are to be sealed, and subsequent pressing together. The back, bottom and top walls of the U-shaped main part 2 are all butt welded along their free edges to the end edges of adjoining walls of the packing container U-shaped main part 1, as also indicated on a larger scale in FIG. 3, where the seal between the top wall or lid 7 and the upper edge of the U-shaped part 1 is illustrated. The lid 7 forms the openable top side of the packing container and extends substantially at a right angle to, and is in hinged connection with, the back 8 of the packing container which, like the lid 7, constitutes part of the U-shaped main part 2. Between the lid 6 and the back 8 a transverse folding line 9 is provided which, as will be explained in the following, also serves as a hinge when the lid 7 is to be opened. This may be done in that the connection of the lid 7 with the U-shaped main part 1 is broken. In order to facilitate this in accordance with the invention, the U-shaped main part 1 is provided at a distance below the lid 7 of the packing container with a weakening line 10 which is situated at a little distance below the weld between the lid 7 and the U-shaped package main part 1 and thus extends parallel with the lid.

Figure 3:
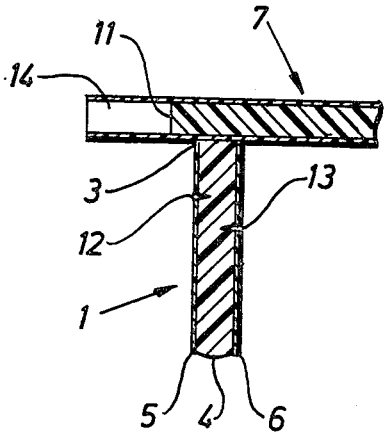
FIG. 3 is a section through a part of the packing container in accordance with FIG. 1 and shows on an enlarged scale a portion of the lid and side wall of the packing container.

To illustrate more clearly the placing and shaping of the weakening line 10, a section through a part of the packing container according to FIG. 1 is shown in FIG. 3, this section showing on a larger scale a part of the lid 7 and how the same is butt welded at a little distance inside its edge 11 to the top edge of the main part 1. From the figure it is also evident how the packing laminate, as mentioned earlier, is made up of a central, relatively thick layer 4 of foamed plastic material which is covered on both sides with relatively thin layers 5, 6 of homogeneous plastic material.

With the aim of making the packing container in accordance with the invention as easily openable as possible, the weakening line 10 ought to be designed so that the material is weakened to the greatest extent feasible. However, the packing container must withstand handling and transport without being unintentionally opened or starting to leak, and the weakening line must be designed, therefore, as a compromise between good openability and sufficient strength. Thus it has proved appropriate to design the weakening line in the form of two mutually parallel cut lines 12, 13 which partially penetrate the packing laminate from opposite sides. More particularly, the cut lines 12, 13 each penetrate one of the two homogeneous, thermoplastic material layers 5, 6 and in addition extend slightly into the centrally situated foamed plastic layer 4. To ensure that the cut lines 12, 13 jointly do not weaken the material to such a degree that a risk of leakage arises, the cut lines are displaced in relation to each other, that is to say they are not right opposite one another. However, in order to achieve openability the cut lines 12, 13 must be located at a relatively short distance from each other, and it has been found appropriate here to choose in general a mutual distance between the cut lines which corresponds substantially to, or slightly exceeds, the total thickness of the packing material. In a packing container of a volume of 2 dl (deciliters) a laminate of a total wall thickness of approx. 1 mm will generally be used. It has been found appropriate in this packing container to provide a vertical distance between the cut lines 12, 13 of 1–1.5 mm. When the cut lines are at this distance the material will be sufficiently strong so that unintentional opening is avoided, while at the same time the area between the cut lines is so short that rupture can be achieved without any difficulty when the user, with the help of a finger gripping below the lid edge, directly presses against the side wall at the level of the weakening line.

The cut lines 12, 13 may also have the form of interruption cuts or perforated lines. The continuous cuts described above are of course most convenient from the production point of view, but a more rigid and stiff packaging wall may be obtained if the lines are interrupted, as in such case the "I-beam-function" of the layers of the wall are partly intact. This is particularly advantageous when filled and finished packing containers are stacked since the risk for deformations decreases.

The weakening line 12, situated on the outside of the U-shaped main part 1, is appropriately placed nearest the lid, and the distance between this cut line and the underside of the lid facing the cut line is substantially equal to, or slightly greater than, twice the material thickness. In other words the distance in the case quoted above will amount to a little over 3 mm. It has been found that placing the cut line at a greater distance from the lid 7 makes the packing container more difficult to open, since in such case the opener's finger is not pressed, as mentioned earlier, directly against the weakening line, when the finger grips around the lid edge. If the weakening line is placed nearer the lid this effect also disappears, thus making the lid more difficult to open, and at the same time a further advantage, which will be described in the following, is lost.

When the lid is opened it is appropriate for practical and aesthetic reasons that the lid should remain whole and plane, and merely be opened with the edge 9 serving as a hinge. However, since the material is flexible, this will not be the case if the material is not provided with some kind of reinforcement. This reinforcement is obtained by placing the weakening line 10 at a suitable distance from the underside of the lid, since the part of the side wall of the packing container situated between the weakening line 10 and the lid is firmly attached to the lid and will then serve as a stiffening rib for the same. This stiffening rib gives the lid 7 an appreciably increased rigidity and also facilitates opening, since the force to which the lid is subjected in upwards direction directly affects the weakened region as soon as the opening has been initiated. The stiffening rib also ensures that the opened lid retains its plane shape. This makes it possible to reclose the packing container by a simple lowering of the lid until the oblique rupture line between the two cutting lines 12, 13 guides the lid back to its correct closed position. The lid 7 is kept in its correct closed position due to the frictional engagement between the rupture surfaces, thus providing reclosability properties to the container. To facilitate the opening, finally, the lid part 7 is provided with a projecting lug 14 which not only facilitates the gripping of the lid 7, but also indicates where on the packing container the opening operation is to be started.

By providing the packing container in accordance with the invention with an integrated openable lid, the previously known type of packing container becomes suitable, without any major redesign, to be used for semi-solid or solid products, which has long been desirable.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not as limiting to the scope and spirit of the invention as set forth in the appended claims.

What is claimed is:

1. A packing container, comprising:

a first U-shaped wall portion defining a back wall and top and bottom end walls of the container; and a second U-shaped wall portion which is sealed to said first wall portion to define a closed container, said second wall portion defining front and side walls of the container, and second wall portion including a weakening line adjacent the top end wall of the container with a central portion of said second wall being continuous and extending across said weakening line, said top end wall and an upper segment of said second wall portion above said weakening line defining a lid for the container, said weakening line being provided for severing said upper segment from said second wall portion to release said lid for hinged movement relative to said back wall, said weakening line being two mutually parallel, vertically displaced cut lines on opposite sides of said second wall portion, the cut line on an outside of the packing container being situated nearest the top end wall, whereby opening said container along said weakening line creates an oblique rupture line between the cut lines for guiding the lid back to a closed position.

2. The packing container of claim 1 wherein said first and second wall portions comprise a laminated material which includes a carrier layer of foamed plastic material which is covered on both sides with a thin homogenous layer of thermoplastic material.

3. The packing container of claim 2, wherein the lid along its free edges is butt welded to the upper end edge of the adjoining packing container side wall, constituted by said second wall portion of the packing container, and wherein said lid extends at an angle with respect to a back wall part of said first wall portion.

4. The packing container of claim 2, wherein the cut lines are vertically displaced from each other by a distance which is approximately equal to the total thickness of the laminated packing material.

5. The packing container of claim 2, wherein the distance between said outside cut line and the side of the lid facing the cut line is approximately equal to twice the laminated packing material thickness.

6. The packing container of claim 1, wherein the upper segment of said second wall portion remains firmly attached to, and serves as a stiffening rib for, the lid.

7. A packing container, comprising:

a first U-shaped wall portion serving as the back wall and top and bottom end walls of the container; and a second U-shaped wall portion serving as the front and side walls of the container, said first and second portions being sealed to one another to define a closed container, said second wall portion having a weakening line adjacent said top end wall of the container with a central portion of said second wall being continuous and extending across said weakening line, an upper segment of said second U-shaped portion being defined above said weakening line and a lower segment being defined below said weakening line, said top end wall with said upper segment sealed thereto defining an openable lid upon tearing of said upper segment from said lower segment along said weakening line, said lid when torn open being hingedly connected to said back wall, said upper segment of said second U-shaped portion remaining attached to said lid to serve as a stiffening rib for said lid, said weakening line includes two mutually parallel, vertically displaced cut lines on opposite sides of the second wall portion, the cut line on an outside of the container being situated nearest the top end wall whereby opening said container along said weakening line creates an oblique rupture line between the cut lines for guiding the lid back to a closed position.

8. The packing container of claim 1 or 7 wherein said lid includes a projecting lug for gripping said lid.

* * * * *